United States Patent [19]

McDermott

[11] 4,445,666

[45] May 1, 1984

[54] HYDRAULIC JACK DEVICE

[75] Inventor: Gertrude D. McDermott, Minneapolis, Minn.

[73] Assignee: Hydra-Jack, Inc., Clear Lake, Iowa

[21] Appl. No.: 321,802

[22] Filed: Nov. 16, 1981

[51] Int. Cl.[3] ..... B66F 3/24

[52] U.S. Cl. ..... 254/93 H; 91/420

[58] Field of Search ..... 254/93 H, 93 R, 2 R, 254/2 B, 8 R, 8 B; 91/420

[56] References Cited

U.S. PATENT DOCUMENTS

| | | | |
|---|---|---|---|
| 2,483,312 | 9/1949 | Clay | 91/420 |
| 3,890,684 | 6/1975 | Tallman | 254/93 H |
| 4,174,095 | 11/1979 | Chipman | 254/93 H |
| 4,192,338 | 3/1980 | Gerulis | 91/420 |
| 4,286,432 | 9/1981 | Burrows et al. | 91/420 |

*Primary Examiner*—Robert C. Watson

*Attorney, Agent, or Firm*—Williamson, Bains, Moore & Hansen

[57] ABSTRACT

A hydraulic jack comprises a base having a vertically disposed cylindrical member attached thereto. A cylindrical movable member is mounted on the fixed member and is vertically movable relative thereto. The base is provided with passages therethrough which are connected in communicating relation to a source of fluid under pressure, such as a reservoir and pump. The fixed and movable members define a pair of variable chambers, each of which is connected in communicating relation with one of the passages by a restricted orifice to reduce the flow of fluid to and from the chambers. When one of the chambers is pressurized, the movable member is raised and will support a load engaged thereby. When the other chamber is pressurized, the movable member is lowered. Fluid in the chambers is prevented from returning to the reservoir by valve elements. A valve actuator is operated by fluid pressure and selectively opens each passage to permit the return of fluid to the reservoir. Relief valves permit the escape of fluid from each chamber when a predetermined pressure is exceeded because of thermal expansion, or excess load.

5 Claims, 6 Drawing Figures

HYDRAULIC JACK DEVICE

SUMMARY OF THE INVENTION

This invention relates to hydraulic jacks and more particularly to a control system for hydraulic jacks.

Hydraulic jacks are used to lift a wide variety of loads including vehicles, building structures, and the like. A hydraulic jack of this class is disclosed in U.S. Pat. No. 4,174,095. It is not uncommon to retain the load supported by the jack in an elevated position for substantial periods of time. It is therefore desirable to provide means for safely locking the jack in the raised condition in the event of failure of the pressure line. Further, when hydraulic jacks are allowed to remain in a load-supporting, elevated condition, the hydraulic fluid will tend to expand when subjected to increases in the temperature of the hydraulic fluid. Therefore means must be provided for preventing damage to a hydraulic jack supporting a load when the hydraulic fluid exerts additional pressure due to thermal expansion.

It is therefore a general object of this invention to provide a control system for a hydraulic jack which locks and retains the hydraulic jack in an elevated, load-supporting position even when there is failure in the pressure supply line to the jack.

A further object of this invention is to provide a novel hydraulic jack with a release valve means which permit the escape of hydraulic fluid into a return line when the hydraulic fluid exceeds a predetermined pressure due to thermal expansion.

These and other objects and advantages of my invention will appear more fully from the following description made in conjunction with the accompanying drawings wherein like reference characters refer to the same or similar parts throughout the several views.

FIGURES OF THE DRAWING

DESCRIPTION OF THE PREFERRED EMBODIMENTS OF THE DRAWINGS

Figure 1:
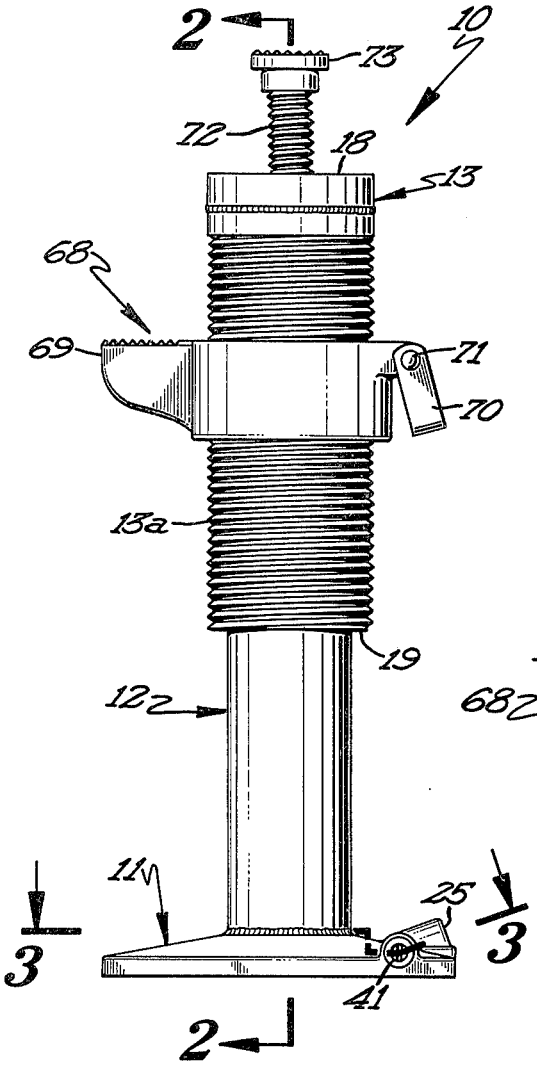
FIG. 1 is an elevational view of the novel jack.
Figure 5:
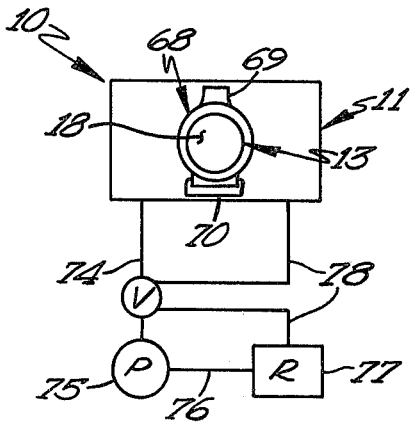
FIG. 5 is a schematic view of the hydraulic jack system.

Referring now to the drawings and more particularly to FIG. 1, it will be seen that one embodiment of the novel hydraulic jack, designated generally by the reference numeral 10, is thereshown. The hydraulic jack includes a generally rectangular shaped base 11 having an elongate, vertically disposed fixed cylindrical member affixed thereto as by welding and projecting upwardly therefrom. The hydraulic jack also includes a movable cylindrical member 13 which has a diameter greater than the diameter of the fixed cylindrical member and which is externally threaded throughout its length by threads 13*a*. A movable cylindrical member 13 is vertically shiftable relative to the fixed member in response to fluid pressure.

The fixed cylindrical member is provided with an annular element 14 having a threaded apperature 15 therethrough which threadedly engages the externally threaded upper end 16 of the fixed cylindrical member. It will be noted that the annular element 14 extends radially outwardly from the upper end of the fixed cylindrical member and has an O-ring seal positioned in an annular groove in its outer edge that sealingly engages the inner surface of the movable cylindrical member 13.

The movable cylindrical member 13 is provided with a circular substantially flat upper end element 18 which is rigidly connected thereto and is also provided with an annular element 19 secured to the lower end thereof. The annular element 19 has a centrally located opening 19*a* therein through which projects the fixed cylindrical member 12. A suitable O-ring seal is positioned in an annular groove in the annular element 19 defined by the opening 20*a* and sealingly engages the exterior surface of the fixed cylindrical member. Thus the movable and fixed cylindrical members sealingly engage each other.

Figure 2:
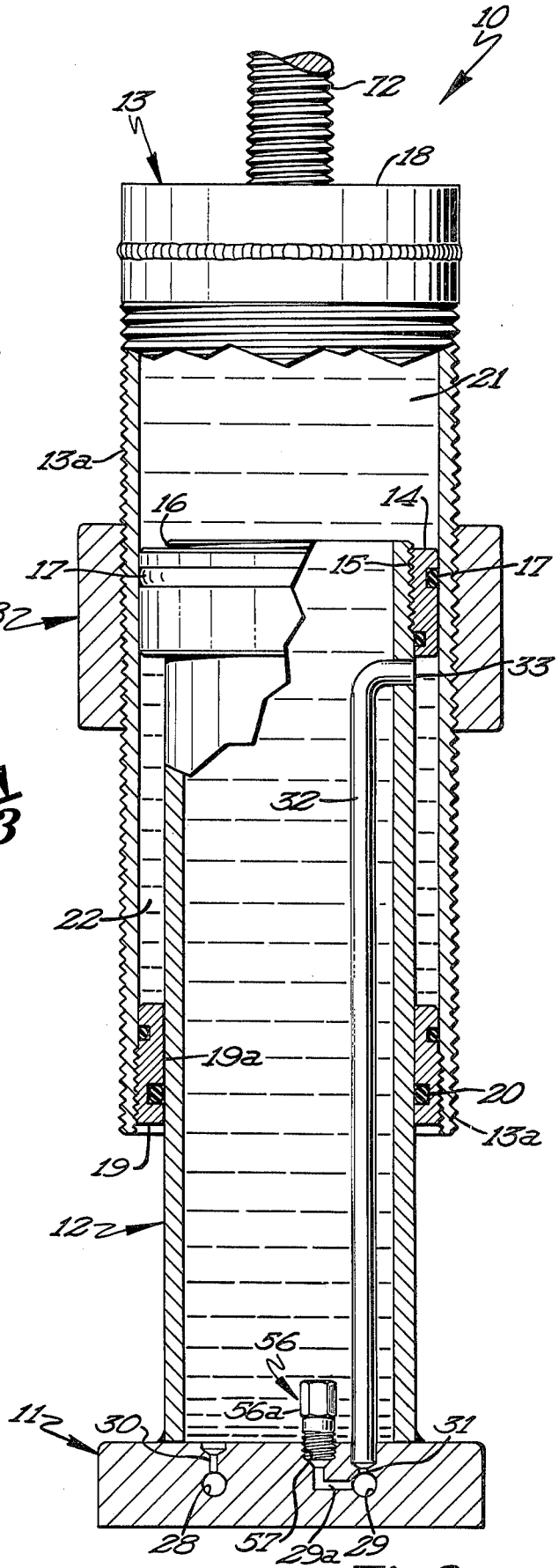
FIG. 2 is an elevational view taken approximately 90 degrees from the position of the jack illustrated in FIG. 1 with certain parts thereof broken away for clarity.

Referring again to FIGS. 1 and 2, it will be seen that the fixed and movable members cooperate with each other to define an extension chamber 21 and a retraction chamber 22. It will be noted that the extension chamber is defined by the interior of the fixed member 12 and that portion of the interior of the movable member located above the annular element 14. The retraction chamber 22 is defined by the interior of the movable member located below the annular element 14 on the fixed member. It will be seen that when fluid under pressure is supplied to the chamber 21, the chamber will expand in response to such fluid pressure and the chamber 22 will proportionally contract. When the chamber 21 is pressurized, the movable member will be elevated and fluid will be evacuated from the chamber 22 in a manner to be described herein below. Similarly, when the chamber 22 is pressurized, it will expand in response to fluid pressure and the movable member will be lowered. When this occurs, the hydraulic fluid in the chamber 21 will be evacuated therefrom.

Figure 3:
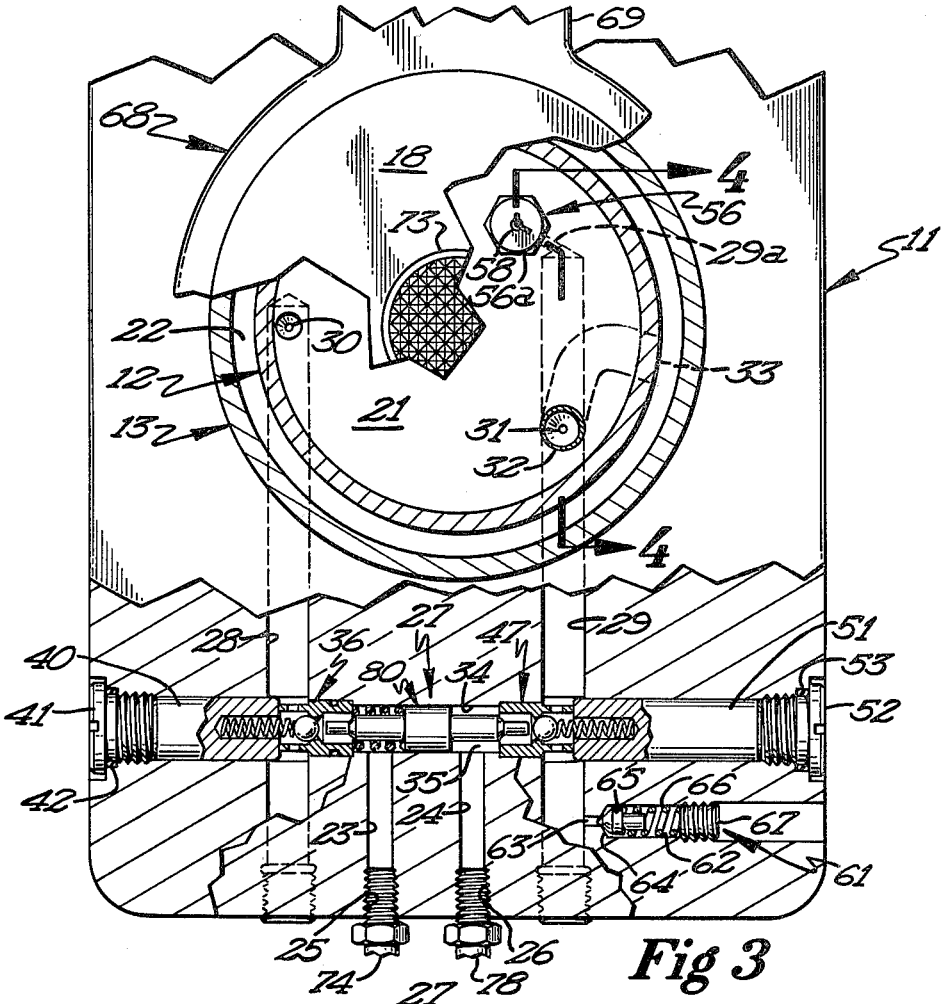
FIG. 3 is a cross-sectional view taken approximately along line 3—3 of FIG. 3 and looking in the direction of the arrows.
Figure 6:
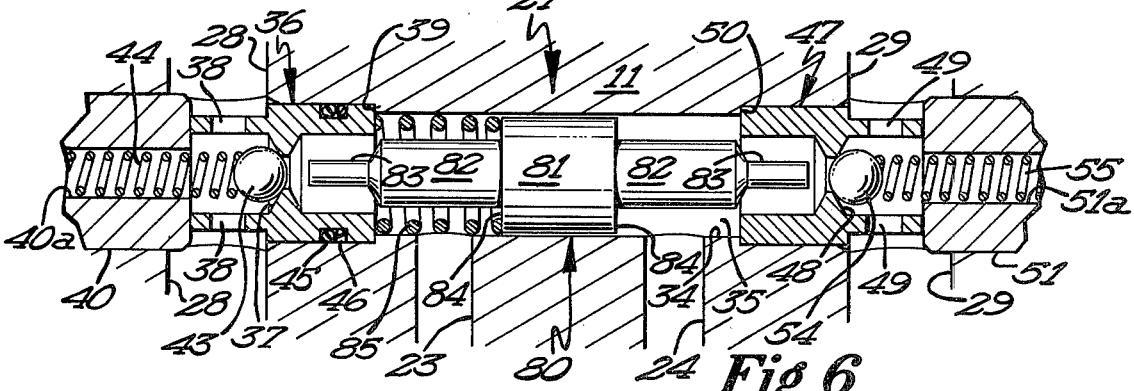
FIG. 6 is an enlarged view of the spool valve actuator illustrating details of construction thereof.
Figure 4:
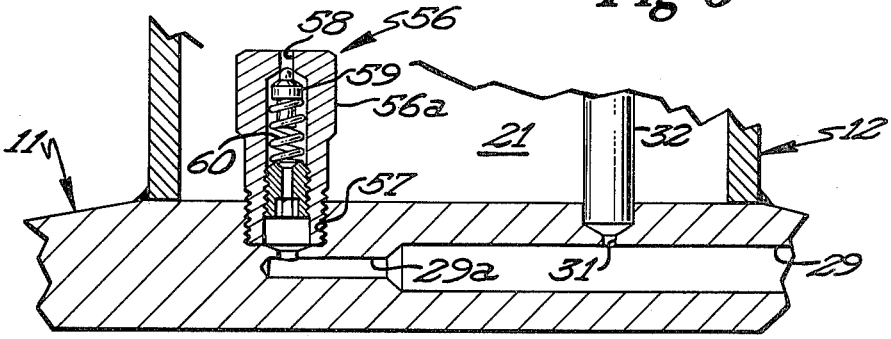
FIG. 4 is a cross-sectional view taken approximately along line 4—4 of FIG. 3 and looking in the direction of the arrows.

Referring now to FIG. 3, it will be seen that the base 11 is provided with a passage 23 and a passage 24. The passage 23 terminates outwardly in an enlarged opening 25 while the passage 24 terminates outwardly in an enlarged opening 26. These enlarged openings accomodate fittings to which conduits are connected. The base 11 is also provided with a control valve mechanism 27 which is disposed in communicating relation with respect to the passages 23 and 24. The control valve mechanism 27 is connected in communicating relation to a passage 28 and to a passage 29. It will be seen that the passage 28 is connected in communicating relation by a restricted orifice 30 to the extension chamber 21. It will further be seen that the passage 29 is connected by a restricted orifice 31 to an elongate vertically disposed pipe or conduit 32 that extends upwardly through the fixed cylindrical member and is provided with an outlet 33 that communicates with the retraction chamber 22. It will be appreciated that the restricted orifices 30 and 31 are of venturi configuration and serve to throttle the flow of fluid to and from the respective chambers 21 and 22.

Referring again to FIG. 3, it will be seen that the base 11 is provided with a transverse bore 34 therethrough which communicates with the passages 23, 24, 28, and 29. The central portion of the transverse bore 34 defines the chamber 35 for the control valve mechanism 27. A check valve housing 36 is positioned in one end portion of the chamber 35 and the check valve housing 36 is provided with a conically shaped valve seat 37. The check valve housing 36 also has an opening 38 therein which communicates with the passage 38. The inner end of the check valve housing 36 engages a shoulder 39 defined by an enlargement of the chamber 35 to limit inward movement of the valve housing. The outer end of the check valve housing 36 engages a check valve stop 40 which is disposed in the end portion of the transverse bore 34 and is retained therein by a plug 41. Plug 41 is provided with an O-ring seal 42 to provide a fluid seal thereat.

A ball type check valve 43 is positioned in the check valve housing 36 and is normally urged against the valve seat 37 by a helical spring 44 that is positioned in an axially extending recess 40*a* in the check valve stop 40. The helical spring 44 holds the check valve 43 against the valve seat in a normally closed position. It will also be seen that the valve housing 36 has an annular groove therein which accomodates an O-ring seal 45 and a back up ring 46. The O-ring seal seals the valve housing with respect to the bore 34 and prevents the escape of fluid around the valve housing.

The control valve mechanism 27 also includes a check valve housing 47 adjacent the other end of the chamber 35 and the check valve housing 47 is also provided with a valve seat 48. The valve housing 47 has an opening 49 therein which communicates with the passage 29. One end of the check valve housing 47 engages a shoulder 50 defined by the bore 34 and the other end of the valve housing is engaged by an elongate check valve stop 51. The check valve stop 51 is retained in engaging relation with the check valve housing 47 by a plug 52. A suitable O-ring seal 53 is positioned around the plug 52 and engages the opening in the base 11 defined by the bore 34 to form a seal thereat.

A ball type check valve 54 is also positioned within the check valve housing 47 and is normally urged against the valve seat 48 by helical spring 55 positioned within an axial recess 51*a* in the check valve stop 51. It is important to note that the check valve housing 47 is not provided with a seal around the exterior thereof so that hydraulic fluid may seep and escape around the exterior of the valve housing under certain conditions.

It will be noted that because the check valves 43 and 54 are normally urged to the closed position by their respective springs, the fluid under pressure will not be returned through the passages 28 and 29. However, it is pointed out that each of the check valves 43 and 54 may be shifted out of the seated or closed relation when fluid under pressure is passed through the passages 23 or 24 and to the chamber 35. In this regard, the fluid pressure produced by the flow of fluid from the source of fluid under pressure, is sufficient to overcome the resistance offered by the helical springs 44 and 55.

Means are provided for selectively shifting the check valve 43 or the check valve 54 from its seated position to permit the selective return of fluid from either the extension chamber or the retraction chamber. This means includes an elongate valve actuator 80 which is positioned in the chamber 35 and is axially movable therein. The valve actuator 80 includes an enlarged central portion 81 which is integral with a pair of intermediate portions 82 that project therefrom. The intermediate portions 82 have a diameter less than the enlarged central portion 81 and each is integral with an end portion 83, the latter projecting from the associated intermediate portion. The end portions 83 are also of reduced cross-sectional size as compared to the intermediate portions 82. The enlarged central portion is only slightly smaller than the cross-sectional size of the chamber 35. The valve actuator 80 is also provided with opposed annular faces 84 that define piston surfaces. It will be seen that when fluid under pressure is supplied through either the passage 23 or 24, the fluid will unseat the associated check valve and will exert pressure against one of the faces 84 to shift the valve actuator 80 axially of the chamber 35. For example, if fluid under pressure is supplied from the source of fluid pressure through the passage 23, the fluid flowing through the passage 23 will enter the chamber 35 and the check valve housing 36 and exert pressure against the check valve to unseat the same and permit the fluid under pressure to flow through the passage 28. The fluid passing through the passage 23 will also act upon face 84 to shift the valve actuator 80 to the right as viewed in FIG. 3 to thereby unseat the check valve 54 and permit the return of fluid through the passage 29 into the passage 24. Similarly, when fluid under pressure is supplied through passage 24, the valve actuator 80 will be shifted axially of the chamber 35 against the bias of a helical spring 85 to disengage the check valve 43 and permit the return of fluid from the passage 28 through the passage 23.

The jack 10 is also provided with a pair of relief valves to prevent damage to the jack and/or the operator when there is a malfunction in the system. To this end, the lifting chamber 21 is provided with a relief valve 56 including a relief valve housing 56*a* which threadedly engages in a threaded recess 57 in the base 11. The relief valve housing 56*a* has an opening 58 therein which defines a valve seat and which communicates with the raising or extension chamber 21. A check valve element 59 is positioned interiorly of the relief valve housing 56*a* and is urged into closing relation with respect to the opening 58 by a spring 60. A small passage 29*a* intercommunicates the interior of the valve housing 56*a* with the passage 29. The valve element 59 will be urged to the open position against the bias of the spring 60 in response to a predetermined pressure to permit fluid under pressure to escape from the lifting chamber into the passage 29.

The jack 10 is also provided with a relief valve 61 for the retraction or lowering chamber 22. The relief valve 61 is provided with a chamber 62 in the base 11 which communicates by a port 63 with the passage 29. The chamber 62 is provided with a valve seat 64 for accomodating a valve element 65 which is movable in the chamber 62. A helical spring 66 normally urges the valve element 65 into seated relation with respect to the valve seat 64. A set screw 67 engages the spring 66 and is adjustable to provide the proper force to be applied by the spring. The valve element 65 will open when the pressure in the lowering chamber 22 exceeds a predetermined magnitude. When the valve element 65 is unseated, the escaping hydraulic fluid will become visibly and audibly perceptive to the operator.

Referring again to FIG. 3, it will be seen that the external threads 13*a* on the movable member 13 are threadedly engaged by an annular lifting element 68 which is internally threaded. The annular lifting element is provided with a lifting finger 69 which projects radially therefrom. The annular lifting element is also provided with a bracket 70 which is pivoted thereto by a pivot 71.

The hydraulic jack 10 is also provided with an externally threaded lifting screw 72 which threadedly engages the threaded opening in the upper end element 18 on the movable member 13. The upper end of the threaded screw is provided with a head 73. It will be seen that the lifting stroke of the jack may be varied by adjusting the annular lifting element 68 relative to the movable member 13 or by adjusting the lifting screw 72 relative to the movable member. It will be appreciated that the load to be lifted may be selectively engaged by either the lifting finger 69 or the lifting screw 72.

It will be seen that the passage 23 and the fitting associated therewith are connected by a conduit 74 through a control valve V to a pump 75. The pump 75 is connected by a conduit 76 to a reservoir 77. The reservoir 77 is connected by a conduit 78 through the control valve V to the passage 24. The pump 75 is reversible so that the direction of flow of the hydraulic fluid may be selectively controlled.

In operation, the hydraulic jack may be raised with or without a load. The speed at which the hydraulic jack is extended or raised is controlled by the orifice diameter 30 and the orifice diameter 31. For example, in a hydraulic unit rated at 25 tons, at 3250 psi, the orifice diameters are 0.032 inches. When the hydraulic jack is raised or extended, hydraulic fluid under pressure will be supplied to the passage 23 from the pump 75 and the pressure exerted in the control valve chamber 35 will cause the check valve 37 to unseat and permit fluid to flow into the passage 68 and thereafter into the lifting or extension chamber 21. As fluid flows into the chamber 35 through the passage 23, the fluid will engage one of the annular faces 84 and will shift the spool valve actuator to the right as viewed in FIG. 3. The valve actuator 80 will then engage and unseat the check valve 54 to permit fluid to return from the passage 29 into the passage 24 and thereafter into the reservoir 77. It will be appreciated that the check valves 43 and 54 each have an area that is approximately one-ninth the area of one of the faces 84 on the spool valve actuator 80. The check valve actuator will remain in this position during the lifting or extension operation. When the lifting operation is complete and the pressure is lowered on the valve actuator 80, the helical spring 55 will cause the check valve 54 to be immediately seated.

During the lowering operation, hydraulic fluid under pressure will be supplied through the passage 24 and into the chamber 35 and the fluid pressure will unseat the check valve 58 to allow fluid under pressure to pass into the passage 29 and thereafter into the lowering chamber 22. As the lowering chamber is pressurized, fluid will be evacuated from the lifting chamber 21. In this regard, the fluid pressure flowing through the passage 24 into the chamber 35 will shift the spool valve actuator 80 to the left against the bias of the spring 85 to unseat the check valve 43 and allow the fluid to return through the passage 23 and to the reservoir 77. It is pointed out that the ratio of the lifting area to the lowering area is approximately 2.5 to 1. Therefore, in the event that the return line was blocked, as by a non-connected quick connector, the relief valve 61 for the lowering chamber would visibly and audibly vent when the lifting pressure reached 40 percent of the lowering chamber relief valve setting. It is pointed out that the metering orifice 31 for the lowering chamber 22 assures satisfactory pressure at low flow to keep the spool valve actuator 80 shifted during the lowering operation. The orifice 30 for the lifting chamber 21 dissipates the lifting pressure to that required merely to return the fluid back to the reservoir.

One of the problems associated with hydraulic jacks is the problem involved with thermal expansion. It will be appreciated that when the hydraulic jack is in a completely raised or extended position and pressure in the lifting chamber increases due to thermal expansion, the increased pressure can cause the jack to be damaged and thereby creates a dangerous situation. However, when this condition occurs, the check valve 59 for the relief valve 56 will be shifted to the open condition and the fluid will escape through the relief valve from the lifting chamber 21 into the passage 29. Even though the check valve 54 will be in a seated condition, fluid can seep around the check valve housing 47 and thereafter return to the reservoir 74. Therefore the check valve 58 permits ultimate equalizing of the pressure in the lifting and lowering chambers in the event of thermal expansion. It will also be appreciated that some of the fluid which passes into the passage 29 may escape through the relief valve 61 and since this will become apparent to an operator, this condition may be readily corrected. However, in the event that an operator is not present, the fluid pressure will escape around the check valve housing 47 to ultimately equalize the pressure in the respective lifting and lowering chambers.

From the foregoing, it will be seen that I have provided a novel control and locking system which is especially applicable to hydraulic jacks and which is also applicable to other fluid pressure systems such as double acting hydraulic cylinders.

It will therefore be seen that I have provided a novel safety control system for hydraulic jacks which functions in a more efficient manner than any heretofore known comparable systems.

While the preferred embodiments of the present invention have been described, it should be understood that various changes, adaptations and modifications may be made therein without departing from the spirit of the invention and the scope of the appended claims.

What is claimed is:

1. A hydraulic jack, comprising:

a base;

an elongate, vertically disposed, cylindrical, fixed member mounted on said base and having an open, upper end, an annular element affixed to said fixed member at the upper end thereof and projecting radially outwardly therefrom;

an elongate, cylindrical, vertically disposed, shiftable movable member having a diameter larger than said fixed member and positioned exteriorly around the latter and having a closed upper end, an annular element affixed to the lower end of said movable member to sealingly engage the fixed member, said annular element on said fixed member sealingly engaging said movable member;

a variable lifting chamber defined by the interior of said fixed member and by that portion of the movable member located above the annular element on said fixed member, a variable lowering chamber defined by the interior of said movable member located below said annular element on said fixed member;

a pair of primary passages in said base each being connected to a source of fluid under pressure, one of said passages being connected in communicating relation to said extension chamber and said other passage being connected in communicating relation with said retraction chamber whereby when fluid is directed into said extension chamber, said movable member will be shifted vertically upwardly and fluid will be evacuated from the retraction chamber, and when fluid is directed into said retraction chamber, the movable member will be shifted vertically downward and fluid will be evacuated from said extension chamber;

a pair of orifices each being disposed between one of said passages and one of said chambers and each orifice having a cross-sectional size substantially less than the associated passage to thereby reduce the volume flow of fluid between a primary passage and its associated chamber;

a control valve mechanism in said base including a chamber disposed in communicating relation with said primary passages;

said control valve mechanism including a pair of check valves each being positioned in flow-controlling relation with one of said primary passages and each being movable between opened and closed positions, yieldable means normally urging each check valve to the closed position to prevent the return of fluid through said passage, each valve being opened in response to fluid pressure exerted thereon from said source;

a shiftable valve actuator disposed in said primary passages and being shiftable in response to fluid pressure produced by fluid flowing through one of said primary passages from said source to cause the valve actuator to engage and unseat the check valve in the other primary passage to permit the return of fluid from the last-mentioned passage and permitting the other valve to be opened in response to the pressure of fluid flowing from said source;

a transfer passage in said base intercommunicating said extension chamber with the primary passage for said retraction chamber, a normally closed pressure-responsive valve disposed in flow controlling relation in said transfer passage whereby when the jack device is in a raised static condition and the pressure in the extension chamber exceeds a predetermined amount, the pressure-responsive valve will open and permit fluid to flow through the transfer passage into the retraction chamber.

2. The hydraulic jack as defined in claim 1 wherein said shiftable valve actuator is of elongate construction and is provided with laterally spaced-apart faces, each face having an area substantially greater than the area presented by each check valve, each face reacting to fluid pressure exerted thereagainst by fluid flowing through one of said passages to selectively shift the valve actuator in opposite directions in response to such fluid pressure.

3. The hydraulic jack as defined in claim 1 and a relief valve communicating with said passage which is connected in communicating relation with the retraction chamber, said lifting chamber having an area substantially 2.5 times greater than the area of said lowering chamber, whereby when said lifting chamber is expanded, and the passage from said lowering chamber is blocked, hydraulic fluid will escape through said relief valve when the lifting chamber pressure reaches approximately 40% of the lowering chamber relief valve setting.

4. The hydraulic jack defined in claim 1 wherein said control valve mechanism includes a pair of check valve housings, each defining a valve seat and each having one of said check valves movable therein, one of said check valve housings being disposed in sealing relation in the primary passage for the extension chamber and the other check valve housing being disposed in non-sealing relation in the primary passage for the retraction chamber, whereby hydraulic fluid will seep around the non-sealed valve housing and return to the source in response to fluid pressure in said last-mentioned primary passage exceeding a predetermined magnitude resulting from hydraulic fluid passing through the pressure responsive valve from the extension chamber into the transfer passage.

5. The hydraulic jack as defined in claim 2 wherein each face of said valve actuator has a surface area at least twice the area presented by each check valve.

* * * * *